US006439350B1

(12) United States Patent
Lence Barreiro et al.

(10) Patent No.: US 6,439,350 B1
(45) Date of Patent: Aug. 27, 2002

(54) DIFFERENTIATING ELEVATOR CAR DOOR AND LANDING DOOR OPERATING PROBLEMS

(75) Inventors: Juan A. Lence Barreiro, Santiago de Compostela (ES); Jun Liu, Hartford; Chouhwan Moon, Glastonbury, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/898,720

(22) Filed: Jul. 2, 2001

(51) Int. Cl.[7] ..... B66B 3/00
(52) U.S. Cl. ..... 187/391; 187/247; 187/316
(58) Field of Search ..... 187/391, 393, 187/313, 316, 317, 284, 291, 247

(56) References Cited

U.S. PATENT DOCUMENTS 4,512,442 A * 4/1985 Moore et al. ..... 187/393
4,750,591 A * 6/1988 Coste et al. ..... 187/391
4,930,604 A * 6/1990 Schienda et al. ..... 187/393
4,936,419 A * 6/1990 Stadler et al. ..... 187/393
5,107,964 A * 4/1992 Coste et al. ..... 187/280
6,193,019 B1 * 2/2001 Sirigu et al. ..... 30/250
6,330,936 B1 * 12/2001 Lence Barreiro et al. ... 187/247

FOREIGN PATENT DOCUMENTS

JP 05162934 A * 6/1993 ..... B66B/3/00
JP 06239546 A * 8/1994 ..... B66B/3/00

* cited by examiner

*Primary Examiner*—Jonathan Salata

(57) ABSTRACT

Signal processing and diagnostic routines (19) of elevator controllers (9–12) count the total number of runs to landings (O-F) of elevators (4–7) along with the number of runs to landings at which a value of a parameter of an elevator door condition or event is notable, (e.g., too high or too low). If any particular parameter is notable at more than one landing, and the ratio of (a) number of runs to landing at which said particular parameter is notable to (b) the total number of runs to landings exceeds a predetermined threshold, the problem is registered as a car door problem; otherwise, the problem is registered as a landing door problem at each landing where the value of the particular parameter is notable.

2 Claims, 1 Drawing Sheet

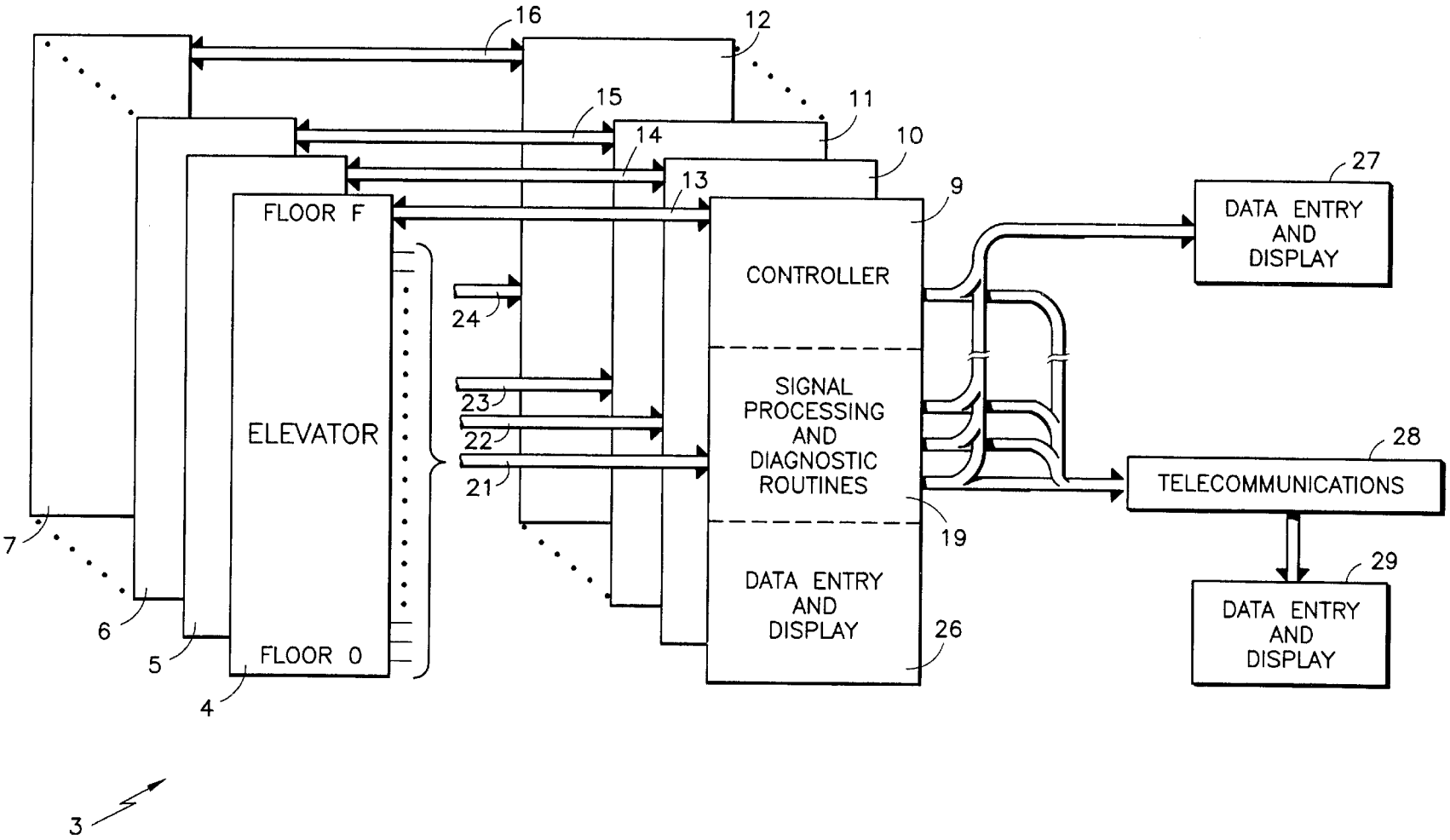
DATA ENTRY AND DISPLAY
27
TELECOMMUNICATIONS
28
DATA ENTRY AND DISPLAY
29
9
10
11
12
13
14
15
16
CONTROLLER
SIGNAL PROCESSING AND DIAGNOSTIC ROUTINES
19
DATA ENTRY AND DISPLAY
26
24
23
22
21
FLOOR F
ELEVATOR
FLOOR 0
4
5
6
7
3

DIFFERENTIATING ELEVATOR CAR DOOR AND LANDING DOOR OPERATING PROBLEMS

TECHNICAL FIELD

This invention relates to a method for differentiating between elevator car door operation problems and landing door operation problems, based upon the number of runs to a landing at which the problem is sensed.

BACKGROUND ART

Known elevator diagnostic systems monitor a limited set of signals from the elevator system itself, such as door switches, door open limit switch, final limit switches, etc., and/or from external sensors such as temperature, vibration, noise, etc. These signals are analyzed and the combination and sequence of them is used to find those problems that require human intervention or a different mode of operation. A good elevator diagnostic system has to be able to detect the failures and point to the part or parts that are the origin of the failures.

One of the most complex mechanisms of an elevator is the door system, since it consists of a large number of mechanical and electrical components working together, and since it undergoes a very large number of operational cycles per unit of time. Elevator maintenance contracts typically require that the elevator be available some high fraction of the time. Many elevator service calls are related to the doors. The ability to identify a fault-causing component depends upon two factors: the amount and quality of the signals available to be used in diagnostics, and the accuracy of the diagnostic algorithms. It would be easy to separate elevator car door problems from elevator landing door problems if the landing door was operated independently; however, this would require each landing door to have its own door motor, position encoder, and motion control process loop. Such would be prohibitively expensive in any elevator system. Therefore, the way to monitor the landing doors is by taking advantage of the daily elevator door operation in providing normal service. This means utilizing all of the car door signals, including position encoder, motor, door open limit, door close limit, and so forth to discriminate, from an analysis thereof with respect to various floors, between abnormal operation originated by the car door from that originated by a landing door.

In a commonly owned, copending U.S. patent application, Ser. No. 09/898853, filed contemporaneously herewith, there is disclosed a method in which the distinction between car door and landing door problems is based on the number of landings at which the given problem is detected over a given period of time, such as at least 40% of the total number of floors having a problem indicating a car door problem, and less than 40% of the total number of floors having a problem indicating landing door problems at those landings. The accuracy of such method depends on traffic patterns that cannot be predicted in a manner sufficient to eliminate erroneous results. For example, an elevator serving ten floors with a diagnostic rule of "at least three floors" may be only serving two floors because the rest are not occupied; then real car door problems will be identified as being in the landing doors when such is not the case.

DISCLOSURE OF INVENTION

Objects of the invention include provision of an improved methodology for discriminating between elevator car door problems and elevator landing door problems; an improved diagnostic methodology for detecting the source of elevator door operational problems; reducing the service time required for elevator door system service calls; and reducing elevator out-of-service time as a function of elevator door system problems.

According to the present invention, the number of runs of the elevator to each particular landing, at which any particular notable elevator door parameter is detected, is utilized to discriminate between elevator car door problems and elevator landing door problems. According to the invention, for any flag which may be indicative of a notable elevator door system condition or event, if at least some percentage (such as, for instance, 60%) of the total number of runs to landings resulted in such flag, and the flag occurred at more than one of the floors, then the problem is stated to be due to a car door component; otherwise, the problem is stated to be a landing door problem at all of the floors which have such flag.

Exemplary conditions which can be considered to be flags include: incorrect door opening or closing time, door slowing due to obstacles in the door path; an incorrect door fully-open or door fully-closed position; a mean door lock position error, or an incorrect variance in door lock position. Other conditions and event with which the invention may be used are disclosed in the aforementioned patent application.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole FIGURE herein is a simplified, stylized, schematic block diagram of an elevator system including diagnostics in accordance with the present invention.

MODE(S) FOR CARRYING OUT THE INVENTION

Referring to the FIGURE, an exemplary elevator installation 3 may comprise a plurality of elevators 4–7, each having a related controller 9–12. Each controller is interconnected, typically by cables 13–16, with the corresponding elevator. In accordance with the invention, each controller 9–12 may have suitable apparatus and software to provide signal processing and diagnostic routines 19 in response to signals received either over the control cables 13–16, or over additional cables 21–24, all of which may be selected to suit any particular elevator installation in a conventional way, and is irrelevant to the present invention. Each controller 9–12 may include data entry and display means 26, although it is more likely that a single data entry and display means 27 will be provided on the site for each elevator installation, which will allow diagnostic interface with respect to all of the elevators 4–7. In addition, it is common to provide results of the diagnostic routines through telecommunications 28 to remote data entry and display means 29. The particular nature of the manner in which the results of the diagnostics are communicated to service personnel are irrelevant to the present invention. The signal processing and diagnostic routines may be resident in apparatus other than the corresponding controller; one for each elevator or shared by several; locally or remote.

A door parameter, y, that is applicable both to landing doors and to the car door is monitored by floor in every door operation. As a result, an array of numbers (y)[i] where i=0, 1, 2, . . . , F, is collected (F being the highest floor). Following are some examples of such a parameter and the door components that could be affecting it, as in said prior copending application.

| Door parameter (y) | Components if problem identified as in the car | Components if problem identified as at a landing |
|---|---|---|
| Door opening time | Car Door (CD) rollers, guide shoes, sill, motor, controller | Landing Door (LD) rollers, guide shoes, sill, counterweight |
| Door closing time | CD rollers, guide shoes, sill, motor, controller | LD rollers, guide shoes, sill, counterweight |
| Obstacles slowing door | CD track, sill | LD track, sill |
| Door fully open position | CD track, sill, controller panels | LD track, sill, panels |
| Door fully closed position | CD track, sill, controller, panels | LD track, sill, panels |
| Mean Door lock position | Door vane position | Door lock position |
| Door Lock position variance | Car rail guides | Guide to guide distance |

The invention uses y[i], floor by floor, to discriminate between car door problems and landing door problems. As a result an array f[i] where i=0 . . . F will be generated. The last step in the prior art process is just counting the number of flags in f[i], that is the number of floors where the problem has occurred. If that number is bigger than a threshold amount, then a car door problem is declared; otherwise a problem at one or several landing doors is declared.

EXAMPLE 1

Prior Art:

Consider an elevator with 10 floors where f[i] is as follows (1=a flag; 0=no flag):

f[0]=1 f[1]=0 f[2]=0 f[3]=1 f[4]=1 f[5]=0 f[6]=0 f[8]=0 f[8]=1 f[9]=0

A problem has been identified at floors 0, 3, 4, and 8. No problem has been identified in the other floors. Since the problem occurs at at least 40% of the landings, the car door will be identified as the root of the problem in the prior art system.

According to the invention, in addition to the number of flags in the array f[i], the traffic pattern of the elevator being monitored is taken into account. A flag at a particular floor will only be as important as the contribution of that floor to the total number of operations being monitored. Therefore, this invention uses, besides the flag array f[i], another array with the number of runs to each floor monitored by landing, n[i], where i=0–F. Note that n[i] contains the number of runs per floor with at least one door operation rather than the number of door operations; this is so because when there is a problem either in the car door or in a landing door, the number of faulty door operations for given run could be very high (e.g., as many times as a passenger retries the door), so n[i] would be a combination of faulty operations plus the traffic pattern, instead of just the traffic pattern. Car parking runs will not be considered unless the door is finally open. If the problem is all at one floor, then it is not a car door problem. The rule that this invention uses is: a car door problem is registered if the sum of runs to the floors with a flag is more than a threshold fraction, at least 50% (such as 60%) of the total number of runs monitored and there is a flag at more than one floor; otherwise, the landing door problem is registered for those floors with a flag.

The algorithm is as follows:

Given n[i] that contains the number of runs per floor, and f[i] that contains the number of problem flags per floor, calculate the number of floors $N_f$ with a problem flag:

$$N_f = \sum_{i=0}^{F} f[i]$$

If $N_f$=0, then no problem has been detected; if $N_f$>1, calculate the percentage of runs Rf to the floors with a problem flag:

$$R_f = 100\left\{\sum_{i=0}^{F} f(i)*n(i)\right\} \Big/ \left\{\sum_{i=0}^{F} n(i)\right\}$$

If $R_f$>60, then register a car door problem; otherwise, register a landing door problem at all those floors where f[i]=1.

EXAMPLE 2:

Using the same f[i] as in example 1:

f[0]=1 f[1]=0 f[2]=0 f[3]=1 f[4]=1 f[5]=0 f[6]=0 f[7]=0 f[8]=1 f[9]=0

Suppose that the traffic pattern is as follows:

| | | | | |
|---|---|---|---|---|
| n[0] = 1,000 | n[1] = 50 | n[2] = 100 | n[3] = 200 | n[4] = 150 |
| n[5] = 75 | n[6] = 70 | n[7] = 80 | n[8] = 100 | n[9] = 60 |

There is a flag in four floors and the number of runs to (initial door operations at) those floors is 77% of the total number of runs; therefore, we are confident enough to say that the problem is in the car door.

Suppose that the traffic pattern is as follows:

n[0]=100 n[1]=1,000 n[2]=100 n[3]=200 n[4]=150 n[5]=75 n[6]=70 n[7]=80 n[8]=100 n[9]=60

There still is a flag in four floors, but now the number of door operations at those floors is just 28% of the total number of runs. This means that the other 68% of the runs did not have any problem, so pointing to the car door is probably wrong. This invention points to the landing door in floors 0, 3, 4, and 8, instead of pointing to the car door.

The aforementioned patent application is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of auditing the operation of an elevator door system of an elevator which makes runs to a plurality of landings, said door system including a landing door at each of said landings and a car door; which method comprises:

during an interval of time, monitoring the value of one or more parameters related to elevator door operation;

determining when the current value of any one of said parameters is notable and the landing at which said elevator is located when any said notable value occurs;

determining the number of runs to any of said landings for which the value of said one parameter is notable, during said interval;

during said interval of time, determining the total number of runs respectively made to each of said landings;

determining the ratio of the number of runs to all of said landings in which said one parameter value was notable to the total number of runs made to all said landings during said interval;

if (a) said one parameter value was notable at more than one of said landings and (b) said ratio exceeds a threshold value; providing a maintenance message indicating that said notable parameter value relates to said car door, otherwise providing a maintenance message indicating that said notable parameter value relates to ones of said landings at which said notable parameter value occurred.

2. A method according to claim 1 wherein said one or more parameters are selected from door opening time, door closing time, door fully open position, door fully closed position, obstacles slowing the door, mean door lock position, and door lock position variance.

* * * * *